United States Patent [19]

Hasebe et al.

[11] 4,155,763

[45] May 22, 1979

[54] COLOR PHOTOGRAPHIC PROCESSING METHOD

[75] Inventors: Kazunori Hasebe, Fujinomiya; Shinzo Kishimoto, Minami-ashigara; Tsutomu Hamaoka, Minami-ashigara; Masakazu Morigaki, Minami-ashigara; Yosuke Nakajima, Minami-ashigara, all of Japan

[73] Assignee: Fuji Photo Film Co., Ltd., Minami-ashigara, Japan

[21] Appl. No.: 831,209

[22] Filed: Sep. 7, 1977

[30] Foreign Application Priority Data

Sep. 7, 1976 [JP] Japan ..... 51-107015

[51] Int. Cl.[2] ..... G03C 7/00

[52] U.S. Cl. ..... 96/55; 96/22; 96/27 E; 96/27 F; 96/60 R; 96/60 BF; 96/61 R; 96/66 HD; 96/66.4; 96/56.5

[58] Field of Search ..... 96/55, 66.4, 66 HD, 96/22, 80, 56.5

[56] References Cited

U.S. PATENT DOCUMENTS

| | | | |
|---|---|---|---|
| 3,335,004 | 8/1967 | Wrisley et al. | 96/22 |
| 3,607,263 | 9/1971 | Battaglini et al. | 96/66 HD |
| 3,658,525 | 4/1972 | Bent et al. | 96/22 |
| 3,721,563 | 3/1973 | Fisch et al. | 96/66.4 |
| 3,994,730 | 11/1976 | Frank et al. | 96/66.4 |

*Primary Examiner*—J. Travis Brown

*Attorney, Agent, or Firm*—Sughrue, Rothwell, Mion, Zinn and Macpeak

[57] ABSTRACT

A method for processing a silver halide color photographic light-sensitive material which comprises developing an image-wise exposed silver halide color light-sensitive material in the presence of (a) an aromatic primary amine color developing agent, (b) hydroxylamine or a hydroxylamine derivative, and (c) a 1-aryl-3-pyrazolidone derivative containing two substituent groups at the 4-position thereof.

12 Claims, No Drawings

COLOR PHOTOGRAPHIC PROCESSING METHOD

BACKGROUND OF THE INVENTION

1. Field of the Invention

The present invention relates to a color photographic processing method and, more particularly, to a color photographic processing method using a color developing solution having improved storage properties.

2. Description of the Prior Art

In photographic processing steps for obtaining color images from image-wise exposed silver halide photosensitive materials, it is well known in the color development step that indoaniline, indophenol or azomethine dyes are formed by the image-wise coupling of the oxidation product of aromatic primary amines with dye-forming couplers, so as to form a photographic image.

It is generally desirable to process these silver halide photosensitive materials in a short period of time. Various proposals have, therefore, been made for expediting color development. In particular, color developing solutions simultaneously using a black-and-white developer as a development accelerator are known as superadditive developing solutions. For example, 1-phenyl-3-pyrazolidone is known to have a very strong development accelerating effect.

The superadditivity of 1-phenyl-3-pyrazolidone is described by G. F. van Veelen, *The Journal of Photographic Science,* Vol. 20, pp. 94–106 (1972); and the like.

However, color developing solutions containing 1-phenyl-3-pyrazolidone are quite unstable, compared with developing solutions (or PQ developers) containing hydroquinone, in combination with hydroquinone, which is usually used for black-and-white development, or ordinary color developing solutions in which 1-phenyl-3-pyrazolidone is not used. It has, therefore, been desired to improve the storability of developing solutions, especially color developing solutions containing 1-phenyl-3-pyrazolidone to be used for commercial photographic processings.

As to this lack of stability, G. F. van Veelen, supra describes that 1-phenyl-3-pyrazolidone incorporated into a color developing solution deteriorates rapidly when exposed to air.

It has been a common practice in the photographic art to incorporate sulfites and hydroxylamine salts as anti-oxidants into color developing solutions containing aromatic primary amine color developers in order to prevent the developing capability of the solutions from being reduced due to aerial oxidation.

These anti-foggants are, however, quite unsatisfactory as a storage improving agent for color developing solutions containing 1-phenyl-3-pyrazolidone since they have only slight effects for color developing solutions of this kind. As a result, precipitates or scum is formed therein by the aerial oxidation of 1-phenyl-3-pyrazolidone per se, by a deterioration due to alkali hydrolysis, and by a decomposition of an intermediate product which has a green color and is formed by the reaction of the aerial oxidation products of 1-phenyl-3-pyrazolidone with aromatic primary amine color developers.

U.S. Pat. Nos. 3,615,503 and 3,823,017 have proposed the use of hydroxyalkenes and 2-anilinoethanol as antioxidants as substitutes for hydroxylamines. The compounds, however, do not provide any effects for color developing solutions containing 1-phenyl-3-pyrazolidone.

Ascorbic acid and its derivatives and hydroxylbenzenes are also known as antioxidants for color and black-and-white developing solutions, but these compounds inhibit color development in color developing solutions and, moreover, provide only slight effects for color developing solutions containing 1-phenyl-3-pyrazolidone, so that the formation of scum and precipitates can be prevented only to a slight extent.

It is also known to use sucrose as an antioxidant for black-and-white developing solutions containing hydroquinone or N-alkyl-p-aminophenol as a developing agent. Sucrose, however, does not provide any effects for color developing solutions containing 1-phenyl-3-pyrazolidone.

SUMMARY OF THE INVENTION

Therefore, an object of the present invention is to provide a color photographic processing method in which color development can be conducted rapidly.

A further object of the present invention is to provide a color photographic processing method using a color developing solution in which the change of photographic sensitivity, density and fog with the lapse of time which may be caused by aerial oxidation, etc., can be reduced.

Another object of the present invention is to provide a color photographic processing method in which color images with higher densities can be formed rapidly.

A still further object of the present invention is to provide a color photographic processing method using a stable color developing solution in which the formation of precipitates and scum with the lapse of time does not occur.

Another object of the present invention is to provide a color photographic processing method using a color developing solution containing 1-aryl-3-pyrazolidone derivative which is stable in color developing solutions and is capable of accelerating the processing.

These and other objects of the present invention will become more apparent from the following detailed description thereof.

It has now been found that these and other objects of the present invention are achieved by incorporating a 1-aryl-3-pyrazolidone derivative with two substituent groups at the 4-position thereof into a color developing solution containing an aromatic primary amine color developer and hydroxylamine or a hydroxylamine derivative.

Accordingly, this invention provides a method for processing an image-wise exposed silver halide color light-sensitive material which comprises developing an image-wise exposed silver halide color light-sensitive material in a developer solution containing (a) an aromatic primary amine color developing agent, (b) hydroxylamine or a hydroxylamine derivative, and (c) a 1-aryl-3-pyrazolidone derivative containing two substituent groups at the 4-position thereof.

DETAILED DESCRIPTION OF THE INVENTION

Examples of preferred aromatic primary amine developers which can be used in the color developing solution according to the present invention include p-phenylenediamine derivatives such as: N,N-diethyl-p-phenylenediamine hydrochloride; 2-amino-5-diethylaminotoluene hydrochloride; 2-amino-5-(N-ethyl-N-laurylamino)toluene; 4-[N-ethyl-N-(β-hydroxyethyl-)amino]aniline hydrochloride; 2-methyl-4-[N-ethyl-N-(β-hydroxyethyl)amino]aniline hydrochloride; N-ethyl-N-(β-methanesulfonamidoethyl)-3-methyl-4-aminoaniline sesquisulfate monohydrate as described in U.S. Pat. No. 2,193,015; N-(2-amino-5-diethylaminophenylethyl)-methanesulfonamide sulfate as described in U.S. Pat. No. 2,592,364; N,N-dimethyl-p-phenylenediamine hydrochloride; 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline, and the salts thereof (e.g., the sulfates, hydrochlorides, sulfites, p-toluenesulfonates, etc.) as described, for example, in U.S. Pat. Nos. 3,656,950 and 3,698,525; and the like.

In general, these developing compounds are preferably used in an amount of from about 0.1 g to about 50 g, particularly from 1 g to 20 g, per liter of the color developing solution.

Hydroxylamine or the hydroxylamine derivative which can be used in the present invention is not particularly limited to any specific kind of hydroxylamine. For example, hydroxylamine per se; N-monoalkylhydroxylamines, such as N-methylhydroxylamine; N,N-diethylhydroxylamine; aminoalkylhydroxylamines, such as those described in U.S. Pat. No. 3,287,125; alkoxyhydroxylamines, such as those described in U.S. Pat. No. 3,293,034; sulfohydroxylamines, such as those described in U.S. Pat. No. 3,287,124; N,N-dialkylhydroxylamines; and heterocyclic N-hydroxylamines, such as N-hydroxylpiperidine; as well as the salts thereof can be used. From a commercial standpoint, such as cost, stability, solubility, availability, usability, etc., generally hydroxylamine sulfate, hydroxylamine hydrochloride, N,N-diethylhydroxylamine, N,N-diethylhydroxylamine oxalate, and the like are preferred. N,N-diethylhydroxylamine is particularly preferred as it is particularly useful for the stabilization of 1-aryl-3-pyrazolidone derivatives.

The hydroxylamine and derivatives thereof used in this invention can be employed individually or in admixture in an amount of from about 0.05 g to about 10 g, particularly from 0.1 g to 5 g, per liter of the developing solution.

Examples of suitable substituent groups for the 4-position of the 1-aryl-3-pyrazolidone derivatives used in the present invention include an alkyl group containing 1 to 4 carbon atoms (e.g., methyl, ethyl, n-propyl, isopropyl, n-butyl, etc.) and a substituted alkyl group which may be substituted with one or more of a hydroxyl group, an alkoxy group, an ester group, an amido group, a halogen atom, etc. Specific examples of substituted alkyl groups which can be used include a hydroxyalkyl group (e.g., hydroxyethyl, hydroxymethyl, etc.), an alkyl group substituted with a sulfonamido group (e.g., methanesulfonamidoethyl), and an alkyl group substituted with an alkoxyl group (e.g., methoxyethyl, ethoxyethyl, etc.). Of these substituent groups, alkyl groups substituted with a hydrophilic substituent, e.g., a hydroxy group, are preferred. In particular, hydroxyalkyl-substituted derivatives are particularly preferred since they have good solubilities in color developing solutions and, upon development, are capable of providing reduced fog densities.

The aryl group at the 1-position of the 1-aryl-3-pyrazolidone derivative used in the invention can be selected from a phenyl group and substituted phenyl groups. Suitable substituent groups which can be substituted on the phenyl group are preferably selected from those having a substituent constant of from about −0.90 to about +0.90, particularly preferably from −0.40 to +0.25. The term substituent constant refers to the Hammett constant δ as described in H. H. Jaffé, *Chemical Reviews*, Vol. 53, p. 191 (1953).

As examples of substituent groups and the position thereof giving rise to a Hammett constant within the above described range include p-OH, p-$CH_3O$-, m-$(CH_3)_2N$-, p-$(CH_3)_3C$-, p-$CH_3$-, m-$NH_2$-, p-$C_2H_5$-, p-$(CH_3)_2CH$-, m-$(CH_3)_3Si$-, m-$CH_3$-, p-$CH_3S$-, p-$C_6H_5O$-, p-$NHCOCH_3$-, m-OH, p-$C_6H_5$-, p-F-, m-COOH, m-$CH_3O$-, p-COOH, m-$CH_3S$-, m-$C_6H_5$-, p-Cl-, p-Br-, and the like.

Two or more of these substituent groups can be employed in combination. The reduction potential of the derivative can be varied by the introduction of substituent groups into the phenyl group.

Since the reduction potential of the 1-aryl-3-pyrazolidone derivative varies depending on the substituent constant described above, an appropriate substituent group can be selected within the above substituent constant range, depending on the use of the developing solution and the kind of color developing agent used in combination therewith.

In particular, by the use of a 1-aryl-3-pyrazolidone derivative with a substituent group in the para position of the aryl ring in the 1-position thereof, the formation of the characteristic intermediate green product, which is formed when 1-phenyl-3-pyrazolidone is used in color developing solutions, and the deterioration of color developing solutions due to the formation of this green product intermediate can be prevented.

Preferred 1-aryl-3-pyrazolidone derivatives which can be used in this invention have the following general formula (I):

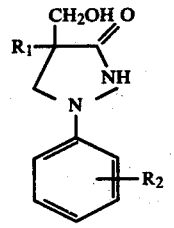

(I)

wherein $R_1$ is a hydroxymethyl group or a methyl group; $R_2$ is a hydrogen atom or a group having a Hammett substituent constant within the range of −0.40 to +0.25.

Typical examples of 1-aryl-3-pyrazolidone derivatives which can be used in the invention are as follows:

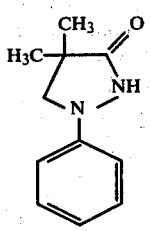

(I)

-continued (II)

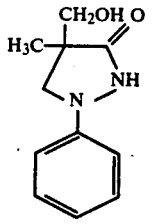

(III)

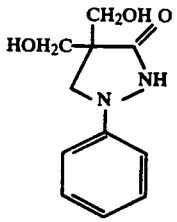

(IV)

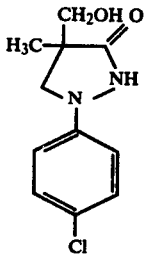

(V)

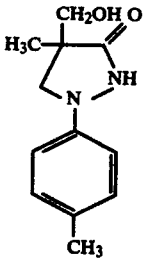

(VI)

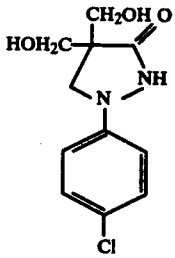

(VII)

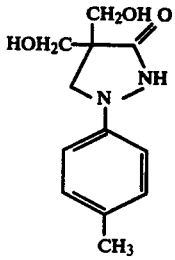

(VIII)

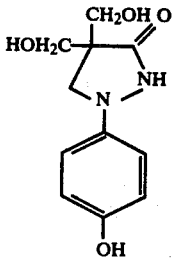

-continued (IX)

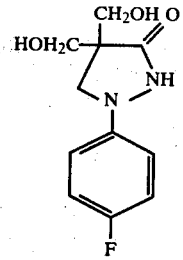

(X)

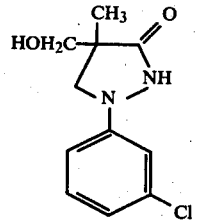

(XI)

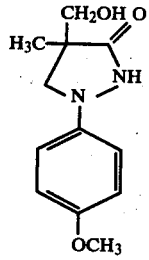

The 1-aryl-3-pyrazolidone derivatives used can be prepared in the same manner as described in U.S. Pat. No. 2,772,282. The hydroxylamine derivatives used can be prepared in the same manner as described in *The Journal of the Chemical Society,* Vol. 119 (1921), page 251 and *Berichte der Deutschen Chemie Gesellschaft,* Vol. 34 (1901), page 2500.

A suitable amount of the 1-aryl-3-pyrazolidone derivative used in this invention ranges from about 0.1 to about 10 g/l, preferably 0.2 to 5 g/l.

While not desiring to be bound, on the basis of experimental results, the reasons for the improvement in stability of the 1-aryl-3-pyrazolidone derivatives in color developing solutions due to the introduction of alkyl or substituted alkyl groups into the 4-position thereof can be presumed to arise for the following reasons:

(1) The values of standard oxidation-reduction potential for one-electron oxidation measured by the polarographic method are changed little by the introduction of alkyl or substituted alkyl groups into the 4-position thereof. Therefore, the degree of susceptibility to one-electron oxidation remains unchanged, so that radicals oxidized by one-electron oxidation may be formed by aerial oxidation, etc., in a similar amount as in the case where 1-phenyl-3-pyrazolidone is used.

Accordingly, it is not 1-phenyl-3-pyrazolidone derivatives per se, but one-electron oxidation products thereof, that are stabilized.

(2) In aqueous alkaline solutions, 1-phenyl-3-pyrazolidone is usually present in the enolic form with respect to the carbonyl group at the 3-position and have a double bond at the 2,3 positions thereof, and a stable radical is formed from this enol compound by one-electron oxidation. The radical may further be converted into a pyrazole which has a double bond at the 4,5 positions thereof. The conversion, however, can be hindered by the introduction of two substituent groups into the 4-position thereof, so that the one-electron oxidation product can be stabilized.

(3) In *Photographic Processing*, p. 101, Edited by Royal Photographic Society, Academic Press, G. F. van Veelen has shown the possibility of the reduction of the above compound (one-electron oxidation product of 1-phenyl-3-pyrazolidone) with aromatic primary amine color developers.

For example, when the hydrogen atom(s) in the 4-position of 1-phenyl-3-pyrazolidone derivatives are replaced with a methyl group or methyl groups, the greater the number of the methyl group(s) introduced, the more increased is the stability of the derivative in color developing solutions and the more the deterioration of photographic properties with the lapse of time is prevented.

On the contrary, the increase in the number of hydrogen atoms replaced with methyl groups apparently results in an increase in coloring which seems to be caused by the deterioration products of 1-phenyl-3-pyrazolidone derivatives in color developing solutions.

Consequently, it can be thought that the introduction of alkyl groups or substituted alkyl groups into the 4-position plays the role of promoting the regeneration, which is caused by color developers, of the one-electron oxidation products into the reduced products thereof, through an increase in the stability of the one-electron oxidation products of the 3-pyrazolidone derivatives.

(4) The lack of stability of 3-pyrazolidone derivatives in color developing solutions is not due to alkali hydrolysis, but to exposure to air, and the reaction of the derivatives with air proceeds much faster than their alkali hydrolysis. The derivatives are stable for quite a long period of time when stored without being brought into contact with air, while the derivatives deteriorate, when allowed in contact with air, in proportion to the area contacted with air.

It is, therefore, apparent that the introduction of substituent groups into the 4-position of 1-phenyl-3-pyrazolidone derivatives serves to prevent a deterioration due to aerial oxidation.

This is a characteristic effect found only in color processing solutions.

It is known that 1-phenyl-3-pyrazolidone derivatives containing two methyl groups in the 4-position thereof have a good stability in black-and-white developing solutions which also contain hydroquinone. This known stability, however, is a stability over a very long period of time based on their fairly insensitive nature to alkali hydrolysis, and, therefore, is of a nature apparently different from the deterioration which occurs in color developing solutions. That is to say, 1-phenyl-3-pyrazolidone derivatives are sufficiently stable in black-and-white developing solutions also containing hydroquinone. This is because hydroquinone is a strong reducing agent and, therefore, the 1-phenyl-3-pyrazolidone derivatives, which are reducing agents weaker than hydroquinone, are hardly reduced in preference to hydroquinone in black-and-white developing solutions, and that the 1-phenyl-3-pyrazolidone derivatives can be regenerated by the hydroquinone to a sufficient extent.

In color developing solutions, however, 1-phenyl-3-pyrazolidone is a reducing agent which is stronger than color developing agents, so that this compound is susceptible to aerial oxidation and deteriorates rapidly, as was shown previously.

Details of the above are described in G. F. van Veelen, *The Journal of Photographic Science*, Vol. 20, pp. 94–106, and J. F. Willems, ibid., pp. 121–134. In these articles, the essential differences in the mechanism of action, stability, etc., of 1-phenyl-3-pyrazolidones in both black-and-white and color developing solutions are elucidated.

A number of references and patents describe 3-pyrazolidone derivatives, and 3-pyrazolidone derivatives having an aryl group or a substituted aryl group in the 1-position of the 3-pyrazolidone ring are described, for example, in British Pat. Nos. 542,502, 943,928, 1,093,281, 1,182,198 and 1,243,112, and U.S. Pat. Nos. 3,453,109, 3,261,885 and 3,740,221.

In addition, British Pat. No. 1,093,281 also describes 1-aryl-3-pyrazolidone derivatives containing one or two hydroxyalkyl substituents and shows that the compounds have improved storage stabilities for a long period of time in alkaline solutions.

However, the fact that 1-phenyl-3-pyrazolidone derivatives substituted with two alkyl or substituted alkyl groups in the 4-position thereof are stable against aerial oxidation in color developing solutions and exhibit photographic properties equal to or superior to those obtained in cases where 1-phenyl-3-pyrazolidone is used, could never been assumed from the descriptions appearing in the prior art.

Moreover, the facts that the adaptability of 1-phenyl-4,4-disubstituted-3-pyrazolidones to color developing agents can be adjusted by introducing a substituent group into the phenyl group, and that the coloration and the stability of color developing agents per se can be improved by the use of 1-phenyl-4,4-disubstituted-3-pyrazolidones further substituted with a substituent group at the p-position of the phenyl nucleus, are surprising in view of the common knowledge concerning 1-phenyl-3-pyrazolidones.

In addition to the above-described hydroxylamine derivatives, color developing solutions containing 3-pyrazolidone derivatives according to the present invention can contain conventional antioxidants, such as sodium sulfite, potassium sulfite, sodium bisulfite and potassium bisulfite. The solutions can also contain known alkali agents or buffers, such as sodium hydroxide, potassium hydroxide, sodium carbonate, potassium carbonate, sodium tertiary phosphate, potassium tertiary phosphate, potassium metaborate, or combinations thereof. Other salts, such as disodium or dipotassium hydrogenphosphate, sodium or potassium hydrogenphosphate, sodium or potassium bicarbonate, boric acid, alkali metal nitrates and alkali metal sulfates, can also be used therein for the purpose of buffering, for convenience in preparation, or in order to increase the ionic strength.

In this invention, the color developing solutions can contain, if desired, any known development accelerators. Examples of useful development accelerators include cationic compounds, such as pyridinium compounds or other compounds, as described in U.S. Pat. No. 2,648,604, Japanese Patent Publication No. 9,503/69, and U.S. Pat. No. 3,671,247; cationic dyes, such as phenosafranine; neutral salts, such as thallium or potassium nitrate; nonionic compounds, such as polyethylene glycol or derivatives thereof, thioethers, etc., as described in Japanese Patent Publication No. 9,504,/69, and U.S. Pat. Nos. 2,533,990, 2,531,832, 2,950,970 and 2,577,127; organic solvents and organic amines, such as ethanolamine, ethylenediamine, diethanolamine, or the like, as described in Japanese Patent Publication No. 9,509/69 and Belgian Patent 682,862; and other accelerators, such as those described by L. F. A. Mason, *Photographic Processing Chemistry*, pp. 40–43, Focal Press, London (1966). Benzyl alcohol and phenylethyl alcohol described in U.S. Pat. No. 2,515,147 and pyridine, ammonia, hydrazine and amines described in *The Journal of the Japanese Photographic Society*, Vol. 14, p. 74 (1952) are also useful development accelerators.

In this invention, the color developing solutions can also contain, if desired, anti-foggants. Examples of useful anti-foggants include alkali metal halides, such as potassium bromide, sodium bromide and potassium iodide; and organic compounds, such as nitrogen-containing heterocyclic compounds, for example, benzotriazole, 6-nitrobenzimidazole, 5-nitroisoindazole, 5-methylbenzotriazole, 5-nitrobenzotriazole, 5-chlorobenzotriazole, etc., mercapto-substituted heterocyclic compounds, for example, 1-phenyl-5-mercaptotetrazole, 2-mercaptobenzimidazole, 2-mercaptobenzthiazole, etc., and mercapto-substituted aromatic compounds, for example, thiosalicylic acid. In particular, nitrogen-containing heterocyclic compounds, especially those which do not contain a mercapto group substituent, are preferred. These antifoggants can be used in an amount of from about 1 mg to about 5 g, preferably from 5 mg to 1 g, per liter of the developing solution.

The color developing solutions of the invention can also contain water softeners. Examples of useful water softeners include polyphosphoric compounds of which sodium or potassium hexametaphosphate, polyphosphate and tripolyphosphate are representative; and aminopolycarboxylic acids of which ethylenediaminetetraacetic acid, nitrilotriacetic acid, cyclohexanediaminetetraacetic acid, iminodiacetic acid, N-hydroxymethyl-ethylenediaminetriacetic acid, and diethylenetriaminepentaacetic acid are representative. The amount of these compounds which can be employed in the developing solutions will vary depending on the hardness of the water used, but a suitable amount usually ranges from about 0.5 g to about 1 g per liter of the solution. Other calcium or magnesium masking agents can also be used in the photographic processing solutions. Examples of such compounds are described in J. Willems, *Belgische Chemische Industrie*, Vol. 21, p. 325 (1956) and ibid. Vol. 23, p. 1105 (1958).

The color developing solutions according to the invention can also contain anti-staining agents or sludge-preventing agents, such as those described in U.S. Pat. Nos. 3,161,513 and 3,161,514, and British Pat. Nos. 1,030,442, 1,144,481 and 1,251,558; interlayer effect-promoting agents, such as those described in U.S. Pat. No. 3,536,487; solvents, such as ethylene glycol; and color-forming agents, such as color couplers.

The pH of the color developing solutions used in this invention can range from about 7 to about 14, preferably from about 8 to about 13.

The temperature at which the color developing solutions used in this invention can be employed ranges from about 20° to about 70° C., preferably from 30° to 60° C.

In the case of color reversal processing, the color developing solutions can additionally contain competing couplers, fogging agents and compensating developers. Examples of useful competing couplers include citrazinic acid, J acid, and H acid. Other examples of competing couplers are described, for example, in U.S. Pat. Nos. 2,742,832, 3,520,690, 3,560,212 and 3,645,737, and Japanese Patent Publication Nos. 9,504/69, 9,506/69 and 9,507/69. Examples of useful fogging agents include alkali metal borohydrides, aminoboranes and ethylenediamine, as well as those described in Japanese Patent Publication No. 38,816/72.

The photographic processing method of this invention can be employed not only for color photographic methods using light-sensitive materials containing color-forming couplers, as described, for example, in U.S. Pat. Nos. 2,322,027, 2,376,679 and 2,801,171, but also to color photographic methods using color developing solutions containing color-forming agents, as described, for example, in U.S. Pat. Nos. 2,252,718, 2,590,970 and 2,592,243.

At present, however, the former methods are mainly practiced. Where color-forming couplers are present in light-sensitive materials, multilayer light-sensitive materials are generally used, and it is preferred for the couplers to remain in particular layers and not to diffuse into other layers during production, storage and processing thereof.

The photographic processing method of the invention can also be employed for diffusion transfer color photographic processes using the methods described, for example, in U.S. Pat. Nos. 3,227,551 and 3,227,552. In this case, the couplers may or have to diffuse into other layers during the processing step thereof.

The photographic processing method of the invention can also be employed for color intensification methods, such as those using hydrogen peroxide, etc., as described, for example, in German Patent Application (OLS) Nos. 1,813,920, 1,950,102, 1,995,901, 1,961,029, 2,044,833, 2,044,993, 2,056,360, 2,056,359 and 2,120,091; or those using Co (III) complexes, as described, for example, in U.S. Pat. Nos. 3,826,652, 3,834,907, 3,748,135 and 3,765,819.

The method of this invention can, therefore, be employed for the processing of any conventional silver halide color photographic materials, such as color negative films, color papers, color positive films, color reversal films, and the like.

In this invention, the processing for such color photographic materials fundamentally comprises the following sequence of steps:

(1) Color Development→Bleaching→Washing→Fixing→Washing→Stabilizing→Drying;

(2) Color Development→Bleach-Fixing→Washing→Stabilizing→Drying; or (3) Color Development→Stop-Fixing→Bleach-Fixing→Washing→Stabilizing→Drying Processing step sequences (1) to (3) can additionally include a treatment using a prebath or a hardening bath prior to the color development. The stabilization or the washing after the bleaching can be omitted.

The sequence of processing steps for color reversal films fundamentally comprises:

(4) Black-and-White Development→Stopping→Washing→Fogging→Washing→Color Development→Bleaching→Washing→Fixing→Washing→Stabilizing→Drying, or (5) Black-and-White Development→Stopping→Washing→Fogging→Washing→Color Development→Bleach-Fixing→Washing→Stabilizing→Drying Processing step sequences (4) and (5) can additionally include a treatment using a prebath, a pre-hardening bath, or a neutralizing bath. The stabilizing step and the washing step after the bleaching can be omitted in sequences (4) and (5) above. The fogging can be effected by an overall exposure, as well as by the use of a fogging bath. The fogging bath can be eliminated by incorporating fogging agents, such as t-butylamineborane, sodium borohydride, tin-aminopolycarboxylic acid complexes and the like into the color developing solutions.

The bleaching and the fixing can be carried out at the same time using a bleach-fixing bath, in sequences (1) to (5) above. A variety of compounds can be used as bleaching agents. Examples of useful bleaching agents include ferricyanides; bichromates, water-soluble cobalt (III) salts; water-soluble copper (II) salts; water-soluble quinones; nitrosophenol; complexes of polyvalent metals, such as iron (III), cobalt (III), copper (II), etc., and organic acids, such as aminopolycarboxylic acids (e.g., ethylenediaminetetraacetic acid, nitrilotriacetic acid, iminodiacetic acid, N-hydroxyethyl-ethylenediaminetriacetic acid, etc.), malonic acid, tartaric acid, malic acid, diglycolic acid, dithioglycolic acid, 2,6-dipicolinic acid; peroxides, such as alkyl peroxides, persulfates, permanganates, hydrogen peroxide, etc.; hypochlorites; chlorine; bromine; bleaching powder; and the like. The compounds can be used either individually or in combination. The bleaching solution can additionally contain various additives, including bleaching promotors, such as those described, for example, in U.S. Pat. Nos. 3,042,520 and 3,241,966, and Japanese Patent Publication Nos. 8,506/70 and 8,836/70.

In the photographic processing method of the invention, the above-described step sequences (1) to (5) are useful, but the invention is not to be construed as being limited thereto.

It is also known to produce color images by exposing color radiographic materials to radiation. Color radiography is well known and can be classified broadly into (A) a type in which conventional multilayer color light-sensitive materials are used as they are, and color images are formed by usual color processings, as described, for example, in U.S. Pat. Nos. 2,807,725, 2,931,904 and 3,114,833; (B) a type in which a coupler-containing photosensitive material is subjected to usual color processings to form color images, as described, for example, in U.S. Pat. Nos. 2,994,610 and 3,121,232, and French Pat. No. 2,077,659; and (C) a type in which a coupler-containing photosensitive material is used and the photosensitive material is processed according to a processing method involving color development, fixing and washing steps (but no silver removal step is involved) to form both dye images, as described, for example, in U.S. Pat. Nos. 3,622,626, 3,627,530, 3,734,735 and 3,809,906, British Pat. No. 1,122,085, German Patent Application (OLS) No. 1,158,836 and Japanese Patent Application (OPI) No. 37,539/72.

Such color radiographic materials have many advantages over black-and-white radiographic materials. For example, the materials provide increased discrimination power and latitude, provide a large amount of information due to better graininess, and are less expensive because of reduced silver halide content. Radiographic materials must be processed very rapidly because of the purposes of their use. In the case of black-and-white radiographic light-sensitive materials, the entire processing, including development, fixing, washing and drying steps, are usually carried out within 2 minutes nowadays.

Accordingly, color radiographic light-sensitive materials must also be capable of being processed rapidly similar to black-and-white radiographic light-sensitive materials. Of the above-described radiographic materials, those belonging to type (C) are most preferred because they can be processed most rapidly since no silver-removal step is used in their processings, and are capable of forming images with high densities by the use of reduced amounts of silver since both dye and silver images contribute to the image density thereof. The term "color radiographic light-sensitive material" as used hereinafter refers to those materials belonging to type (C) described above, unless otherwise noted.

In this invention, the basic process for processing color radiographic materials can also include development, fixing, washing and drying, different from the processing of usual color light-sensitive materials, where a silver-removal step is involved. The processing is radiographic materials is preferably carried out using automatic developing machines, for example, roller-, chain- or belt-transporting type automatic developing machines.

The color developing solutions containing 3-pyrazolidone derivatives according to the invention are extremely advantageous for the processing of color radiographic light-sensitive materials, where rapid processing is especially required, since the developing solutions are capable of developing the materials at a quite rapid rate, compared with the time required for usual color developing processing.

In the photographic light-sensitive materials used in the practice of the invention, any supports which are conventionally employed for photographic light-sensitive materials can be used. Examples of useful supports include cellulose nitrate films, cellulose acetate films, cellulose acetate butyrate films, cellulose acetate propionate films, polystyrene films, poly(ethylene terephthalate) films, and laminated products thereof, and paper. These supports also can be colored. Examples of dyes which can be used for the coloring of such films are described in U.S. Pat. Nos. 2,571,319, 3,372,138, 3,488,195, 3,359,230, 3,413,257, 3,530,132, 3,487,041 and the like. Other supports, such as paper coated or laminated with baryta or an $\alpha$-olefin polymer, particularly of an $\alpha$-olefin containing 2 to 10 carbon atoms, such as polyethylene and polypropylene; and synthetic resin films having a roughened surface with an improved printing property and an increased adhesive property to other high molecular weight materials, as described in Japanese Patent Publication No. 19,068/72, are also preferred.

A variety of hydrophilic colloids can be used in the photographic light-sensitive materials employed in the practice of the invention. Examples of suitable hydrophilic colloids which can be used as binders for photographic emulsion layers and/or other photographic layers include gelatin, colloidal albumin, casein, cellulose derivatives, such as carboxymethyl cellulose, hydroxyethyl cellulose, etc., agar-agar, sodium alginate, saccharide derivatives, such as starch derivatives, etc., synthetic hydrophilic colloids, such as poly(vinyl alcohol), poly(vinyl pyrrolidone), acrylic acid copolymers, polyacrylamides, and the derivatives or partial hydrolysis products thereof. If desired, compatible mixtures of two or more of these polymers can be used.

Of these polymers, gelatin is most widely used, but the gelatin can be partly or completely replaced with gelatin derivatives, such as those modified with agents having a functional group capable of reacting with the amino, imino, hydroxyl or carboxyl groups present in gelatin, and graft polymers produced by grafting other polymeric chains to gelatin, as well as synthetic polymers.

Photographic emulsion layers and other layers of the color light-sensitive materials used in the practice of the present invention can contain, individually or in combination, synthetic polymers, e.g., latex-type water dispersable vinyl polymers, particularly those capable of improving the dimensional stability of the photographic materials. These polymers can also be used in combination with hydrophilic waterpermeable colloids. Examples of such synthetic polymers are described, for example, in U.S. Pat. Nos. 2,376,005, 2,739,137, 2,853,457, 3,062,674, 3,411,911, 3,488,708, 3,525,620, 3,635,715, 3,607,290 and 3,645,740, and British Pat. Nos. 1,186,699 and 1,307,373. Of the polymers described in the above listed patents, copolymers and homopolymers produced from monomers selected from alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride, are generally used. If desired, the so-called graft type emulsion polymerization latexes produced in the presence of hydrophilic protective colloidal polymers can be used.

The photographic emulsions and/or other photographic layers can be hardened using conventional techniques. Examples of useful hardeners include aldehyde compounds, such as formaldehyde and glutaraldehyde; ketone compounds, such as diacetyl and cyclopentanedione; reactive halogen-containing compounds, such as bis(2-chloroethyl urea), 2-hydroxy-4,6-dichloro-1,3,5-triazine and those described, for example, in U.S. Pat. Nos. 3,228,775 and 2,732,303, and British Pat. Nos. 974,723 and 1,167,207; reactive olefin-containing compounds, such as divinyl sulfone and 5-acetyl-1,3-diacryloylhexahydro-1,3,5-triazine, as well as those described, for example, in U.S. Pat. Nos. 3,635,718, 3,232,763, 3,490,911 and 3,642,486, and British Pat. No. 994,869; N-methylol compounds, such as N-hydroxymethylphthalimide and those described, for example, in U.S. Pat. Nos. 2,732,316 and 2,586,168; isocyanates, such as those described in U.S. Pat. No. 3,103,437 and the like; aziridine compounds, such as those described in U.S. Pat. Nos. 3,017,280 and 2,983,611; acid derivatives, such as those described in U.S. Pat. Nos. 2,725,294 and 2,725,295; carbodiimide compounds, such as those described in U.S. Pat. No. 3,100,704; epoxy compounds, such as those described in U.S. Pat. No. 3,091,537; isooxazole compounds, such as those described in U.S. Pat. Nos. 3,271,313 and 3,543,292; halocarboxyaldehydes, such as mucochloric acid, etc.; and inorganic compounds, such as chromium alum and zirconium sulfate. Instead of these compounds, precursors of hardeners, such as alkali metal bisulfite aldehyde adducts, methylol derivatives of hydantoin, primary aliphatic nitro alcohols, and the like can also be used.

The silver halide photographic emulsions which can be present in the photographic materials used in the practice of the present invention can be prepared by mixing a solution of a water-soluble silver salt (e.g., silver nitrate) with a solution of a water-soluble halogen salt (e.g., potassium bromide) in the presence of a solution of a water-soluble polymer (e.g., gelatin).

Silver chloride and bromide, as well as mixed silver halides, such as silver chlorobromide, iodobromide and chloroiodobromide can be used as the silver salt. In the case of color radiographic materials, silver iodobromides having an iodide content of about 10 mol% or less are preferred. The silver halide grains can be prepared using any of the conventional methods, including the single jet method, the double jet method, and the controlled double jet method. Mixtures of two or more of separately prepared silver halide photographic emulsions can also be used.

In order to prevent a reduction in sensitivity and a generation of fog during the production, storage and processing of the photosensitive materials in the practice of the invention, the photographic emulsions thereof can contain a variety of compounds, including mercury-containing compounds, mercapto compounds, metal salts, and heterocyclic compounds, such as 4-hydroxy-6-methyl-1,3,3a,7-tetrazaindene, 3-methylbenzothiazole and 1-phenyl-5-mercaptotetrazole. Examples of useful compounds are described, for example, in U.S. Pat. Nos. 1,758,576, 2,110,178, 2,131,038, 2,173,628, 2,697,040, 2,304,962, 2,324,123, 2,324,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,619,198, 3,622,339 and 3,650,759, and British Pat. Nos. 893,428, 403,789, 1,173,609 and 1,200,188.

The silver halide emulsions used in the photographic materials which are applicable to the practice of the present invention can also be chemically sensitized. Examples of useful chemical sensitizers include gold compounds, such as chloroaurates and gold trichloride, as described, for example, in U.S. Pat. Nos. 2,399,083, 2,540,085, 2,597,856 and 2,597,915; salts of noble metals, such as platinum, palladium, iridium, rhodium and ruthenium, as described, for example, in U.S. Pat. Nos. 2,448,060, 2,540,086, 2,566,245, 2,566,263 and 2,598,078; sulfur compounds capable of reacting with silver salts to form silver sulfide, such as those described, for example, in U.S. Pat. Nos. 1,574,944, 2,410,689, 3,189,458 and 3,501,313; and reducing substances, such as stannous salts, amines, etc., as described, for example, in U.S. Pat. Nos. 2,487,850, 2,518,698, 2,521,925, 2,521,926, 2,694,637, 2,983,610 and 3,201,254.

The photographic emulsions present in the photosensitive materials used in the practice of the present invention can also contain quaternary ammonium salts and polyethylene glycols as a development accelerator.

If desired, the photographic emulsions thereof can be spectrally sensitized or supersensitized by the use, individually or in combination, of cyanine dyes, such as cyanines, merocyanines, carbocyanines, etc., or by the use of combinations of cyanine and styryl dyes. These color sensitization techniques are well known and are described, for example, in U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Pat. Nos. 1,195,302, 1,242,588 and 1,293,862, German Patent Application (OLS) Nos. 2,030,326 and 2,121,780, Japanese Patent Publication Nos. 4,936/68, 14,030/69 and 10,773/68, U.S. Pat. Nos. 3,511,664, 3,522,052, 3,527,641, 3,615,613, 3,615,632, 3,617,295, 3,635,721 and 3,694,217, and British Pat. Nos.

1,137,580 and 1,216,203. The selection of these dyes can be made as desired depending on the purpose and the use of the light-sensitive materials to be produced. For example, where a color radiographic light-sensitive material, which generally has a regular or ortho color sensitivity, is to be spectrally sensitized to light in the wavelength region of about 480 to about 600 nm, the sensitizing dyes described in Japanese Patent Publication No. 14,030/69 and Japanese Patent Application (OPI) Nos. 33,626/72 and 59,828/73 are preferably used.

The photographic layers of the photographic light-sensitive materials used in the practice of the present invention can contain plasticizers, such as polyols of the kind described, for example, in U.S. Pat. Nos. 2,960,404, 3,042,524, 3,520,694, 3,656,956 and 3,640,721.

The photographic light-sensitive materials used in the practice of the present invention can be contain, in addition to silver halide emulsion layers, conventional light-insensitive layers, such as a protective layer, a filter layer, an interlayer, an antihalation layer, a subbing layer, a backing layer, an antistatic layer and a curl-balancing layer. In the case of color radiographic light-sensitive materials, silver halide emulsion layers can be provided on both sides of the support.

The light-insensitive layers of the photographic light-sensitive materials used in the practice of the present invention can contain brighteners, such as stilbenes, triazines, oxazoles and coumarins; UV absorbers, such as triazoles, triazolidines and cinnamates; light-absorbing materials, such as those known as filtering dyes for photographic use or dyes used for the desensitization thereof to a dark room light (or a safelight); and lubricants or adhesion-preventing agents, such as surface active agents as described, for example, in U.S. Pat. No. 3,617,286 and water-insoluble materials as described, for example, in British Pat. Nos. 1,320,564 and 1,320,565 and U.S. Pat. No. 3,121,060; as well as matting agents, such as inorganic compounds having an appropriate grain size (e.g., silver halides, silica, strontium or barium sulfate, etc.), and latexes of polymers such as poly(-methyl methacrylate) or the like.

The photographic emulsion layers and other photographic layers, particularly the outermost layers, of the photographic light-sensitive materials used in the practice of the present invention can contain antistatic agents, including hydrophilic polymers, such as those described, for example, in U.S. Pat. Nos. 2,725,297, 2,972,535, 2,972,536, 2,972,537, 2,972,538, 3,033,679, 3,072,484, 3,262,807, 3,525,621, 3,615,531, 3,630,743, 3,653,906, 3,655,384 and 3,655,386, and British Pat. Nos. 1,222,154 and 1,235,075; hydrophobic polymers, such as those described, for example, in U.S. Pat. Nos. 2,973,263 and 2,976,148; biguanide compounds, such as those described, for example, in U.S. Pat. Nos. 2,584,362 and 2,591,590; anionic compounds of the sulfonic acid type, such as those described, for example, in U.S. Pat. Nos. 2,639,234, 2,649,372, 3,201,251 and 3,457,076; phosphates and quaternary ammonium salts, such as those described, for example, in U.S. Pat. Nos. 3,317,344 and 3,514,291; cationic compounds, such as those described, for example, in U.S. Pat. Nos. 2,882,157, 2,982,651, 3,399,995, 3,549,369 and 3,564,043; nonionic compounds, such as those described, for example, in U.S. Pat. No. 3,625,695; amphoteric compounds, such as those described, for example, in U.S. Pat. No. 3,736,268; complexes, such as those described, for example, in U.S. Pat. No. 2,647,836; and organic salts, such as those described, for example, in U.S. Pat. No. 2,717,834.

The silver halide photographic emulsions used in the photosensitive materials subjected to the process of this invention can contain the so-called couplers, or compounds capable of reacting with the oxidation products of developing agents to form dyes.

Open chain diketomethylene compounds, which have been widely used, can be used as yellow couplers. Examples of useful yellow couplers are described, for example, in U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, and German Patent Application (OLS) Nos. 2,057,941, 2,213,461, 2,219,917, 2,261,361 and 2,263,875.

5-Pyrazolone compounds, which have been chiefly employed, indazolone compounds or cyanoacetyl compounds can be used as magenta couplers. Examples of useful magenta couplers are described, for example, in U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Application Nos. 21,454/73 and 56,050/73, German Patent Application (OLS) No. 1,810,464, Japanese Patent Application (OPI) No. 45,971/73, and U.S. Pat. No. 2,983,608.

Phenol or naphthol derivatives can be used as cyan couplers. Examples of useful cyan couplers are described, for example, in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, German Patent Application (OLS) No. 2,163,811, Japanese Patent Publication No. 28,836/70, and the Japanese Patent Application No. 33,238/73.

The photographic layers of the photographic light-sensitive materials used in the practice of the present invention can also contain couplers which, upon color-forming reaction, release development-inhibiting compounds (the so-called DIR couplers), or compounds which release development-inhibiting compounds. Examples of such couplers or compounds are described, for example, in U.S. Pat. Nos. 3,148,062, 3,227,554, 3,253,924, 3,617,291, 3,622,328, 3,705,201, 3,297,445, 3,379,529 and 3,639,417, and British Pat. No. 1,201,110.

In order to achieve the properties required for the light-sensitive materials, two or more of the above-described couplers, etc., can be used together in a single layer, and the same coupler can be incorporated in two or more photographic layers.

In the color radiographic materials used in the practice of the present invention, the wavelength region to be absorbed by the color images formed therein is not particularly limited, but cyan or blue images having a main absorption in the red wavelength region (about 600 to about 700 nm) or the green wavelength region (about 550 to about 600 nm) of the spectrum are preferred. Phenol or $\alpha$-naphthol color couplers having a maximum absorption in the wavelength region of about 550 to about 700 nm of the spectrum are particularly preferred for the above purpose. Examples of such couplers are described, for example, in U.S. Pat. Nos. 2,772,162, 3,222,176, 3,758,308, 3,737,318, 3,591,383 and 3,476,563, British Pat. Nos. 1,201,110, 1,038,331, 727,693 and 747,628, and Japanese Patent Application (OPI) No. 4,480/72.

The color couplers can be dispersed either by (a) a method for dispersing couplers comprising dissolving the couplers in an oil or by (b) a method for dispersing couplers by dissolving the couplers in water.

Those couplers containing hydrophilic groups such as carboxyl, sulfo, etc., are preferably used as couplers for color radiographic light-sensitive materials, in view of their suitability to rapid processing. The dispersing of such couplers can be advantageously achieved using method (b) described above.

In method (a) described above, a solution obtained by dissolving a hydrophobic coupler in an organic solvent having a high boiling point can be dispersed directly into photographic emulsions, etc., in the form of fine colloidal particles thereof, or the coupler dispersion can be dispersed into an aqueous medium and then the dispersion incorporated into photographic emulsions, etc.

In method (b) described above, water-soluble color couplers having one or more ballasting groups, such as long-chained aliphatic groups (e.g., alkyl or alkylene groups containing 5 to 20 carbon atoms), and having one or more water-solubilizing groups, such as carboxyl and sulfo groups, can be dissolved in a solution of an alkali metal hydroxide in water or in a mixture of water and an alcohol (e.g., an aqueous alkaline solution or an alcoholic potassium hydroxide solution) and then dispersed into a photographic emulsion directly or after being dispersed into a composition containing a hydrophilic colloid, for example, an aqueous solution of a hydrophilic colloid or a molten gel containing a hydrophilic colloid.

In the present invention, the image-wise exposure for obtaining photographic images can be carried out using conventional methods. Any known light sources can be used, including natural light (sunlight), tungsten lamps, fluorescent light lamps, xenon arc lamps, carbon arc lamps, xenon flash lamps, cathode-ray tube flying spots, or the like. A suitable time for the exposure can range from about 1/1,000 sec. to about 1 sec. as is usually employed with a camera, or can be shorter than about 1/1,000 sec., for example, can be from about $1/10^4$ sec. to about $1/10^6$ sec. as in the case where a xenon flash lamp or a cathode-ray tube is used. The image-wise exposure time can also be longer than 1 sec. If desired, the spectral composition of the light used for the image-wise exposure can be controlled by the use of color filters. The image-wise exposure can also be effected using laser light.

In the present invention, the image-wise exposure of color radiographic light-sensitive materials for medical use can be carried out using X-ray emitting tubes in combination with fluorescent intensifying screens, and the type of the screen used therefor is not particularly limited. Examples of preferred fluorescent intensifying screens include those emitting green light, such as those described, for example, in U.S. Pat. No. 3,809,906, and Japanese Patent Application (OPI) No. 63,424/74.

Some of the effects and advantages obtainable by the present invention are as follows:

(1) A very rapid color development can be achieved even at lower developing temperatures because of the exceptionally large superadditive effects on the color development characteristics of the 1-aryl-3-pyrazolidone derivatives used in the invention.

(2) The time and cost of the color developing process can be reduced since the color development can be conducted quite rapidly at lower temperatures.

(3) Color radiographic materials, which must be processed using an automatic developing machine in a very short time, can be processed with particular advantage since the color development can be carried out quite rapidly at lower temperatures.

(4) Rapid and stable color developing solutions can be prepared, even when a small amount of color developing agents having weaker developing capabilities is used, by simultaneously using 4,4-disubstituted-1-aryl-3-pyrazolidiones according to the invention, so that the use of large amounts of color developing agents having strong developing capabilities (which tend to cause skin rashes) as in the prior art color developing solutions for rapid processing, can be avoided. Therefore, the cost of color developing solutions can be reduced and the concern as to the development of a rash can be eliminated.

(5) The stability (particularly to air) of color developing solutions can be remarkably improved by the use of the 4,4-disubstituted derivatives of 1-aryl-3-pyrazolidones, so that the deterioration of photographic properties with the lapse of time can be greatly reduced.

(6) The formation of precipitates and scum in color developing solutions due to a deterioration with the lapse of time, which is characteristic of color developing solutions containing 1-aryl-3-pyrazolidones, can be prevented since color developing solutions with markedly improved stability to the lapse of time can be obtained by the use of the 4,4-disubstituted derivatives of 1-aryl-3-pyrazolidones.

(7) Restrictions on the handling of color developing solutions, e.g., the need for large scale supplementation, shielding from contact with air, and the strict control of color developing solution compositions, due to their lack of stability with the lapse of time can be relaxed since the stability of color developing solutions can be greatly improved by the use of 4,4-disubstituted derivatives of 1-aryl-3-pyrazolidones.

(8) By introducing a substituent group having a substituent constant of from −0.40 to +0.25 into the aryl group, 1-aryl-3-pyrazolidone derivatives having optimum reducing capability depending on their use and the kind of color developing agents used in combination therewith can be obtained.

(9) The green coloration caused by 1-phenyl-3-pyrazolidone in prior art color developing solutions can be prevented by the use of 1-phenyl-3-pyrazolidone derivatives with a substituent group at the p-position of the phenyl nucleus.

(10) The deterioration and coloration of color developing solutions caused by a green coloration due to 1-phenyl-3-pyrazolidone can be prevented since the coloration can be prevented by the use of 1-phenyl-3-pyrazolidone derivatives with a substituent group at the p-position of the phenyl nucleus.

(11) Higher contrasts can be obtained by the process of the prevent invention, so that the process is particularly suitable for the processing of color radiographic light-sensitive materials.

The present invention is further illustrated by the following examples using color radiographic light-sensitive materials, but it is to be understood that the invention is not to be construed as being limited thereto. Unless otherwise indicated herein, all parts, percents, ratios and the like are by weight.

EXAMPLE 1

To 50 ml of a 1% by weight sodium hydroxide aqueous solution (40° C.) was added 3 g of a color coupler of the following formula:

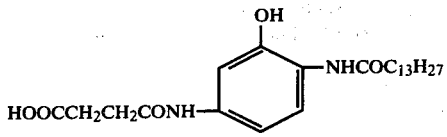

To 57 g of a silver halide photographic emulsion containing 5.4 g of silver chloroiodobromide (iodide content: about 0.5 mol%) with a mean grain size of 0.5 to 1.5μ and 7 g of gelatin were added 6 ml of a 10% by weight citric acid aqueous solution and 2 ml of a 5% by weight chromium alum aqueous solution, and then the above coupler solution was dispersed therein. To the resulting dispersion were added a spectral sensitizer having the following formula:

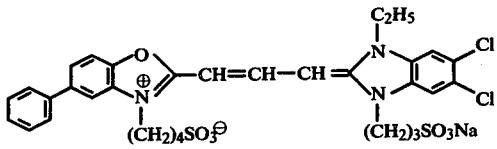

in an amount of about 0.08 mg per 50 mg of silver, and a coating aid to produce a silver halide photographic emulsion having a pH of about 6.5.

The silver halide emulsion was coated on both sides of a polyester film with a thickness of about 180μ at a coverage of silver of about 50 mg/100 $cm^2$ to prepare a light-sensitive material.

The light-sensitive material was exposed to light from a tungsten lamp through a filter (SP-15, made by the Fuji Photo Film Co., Ltd.) in an amount of 1.6 CMS and then subjected to the following processings:

| Processing Steps | Temperature (° O.) | Time (sec.) |
|---|---|---|
| Color Development | 35 | 60 |
| Fixing | 35 | 60 |
| Washing | 25 | 60 |

The processing solutions used had the following compositions:

Color Developing Solution

| | | |
|---|---|---|
| Disodium Ethylenediaminetetraacetate | 2 | g |
| Sodium Sulfite | 10 | g |
| N,N-Diethylhydroxylamine | 5 | ml |
| N,N-Diethyl-p-phenylenediamine Sulfate | 6 | g |
| Potassium Carbonate | 30 | g |
| Potassium Bromide | 2 | g |
| 5-Nitrobenzimidazole | 30 | mg |
| Turkey Red Oil | 5 | mg |
| 1-Phenyl-3-pyrazolidone Derivative (see Table 1 below) | 0.8 | g |
| Water to make | 1 | l |

The pH of the color developer solution was adjusted to 10.2 (using sodium hydroxide or sulfuric acid as needed).

Fixing Solution

Acidic hardening fixer consisting essentially of an aqueous solution of ammonium thiosulfate In a 1-liter beaker was placed 500 ml of the freshly prepared color developing solution, and the solution was allowed to stand for 2 or 3 weeks at 25° C. at 60% RH. The degree of coloration and precipitation in the color developing solution was examined and the solution was used for the development of the above light-sensitive material.

This test was repeated in the same manner as above, except that the amount of un-, mono- and di-substituted 1-phenyl-3-pyrazolidone derivatives described were used as the additive in the above-described color developing solution to determine the effects of the introduction of substituent groups into the 4-position of the compound. The results obtained are shown in Table 1 below.

In Table 1, the symbol ΔD describes the difference between the visual density ($D_f$) of the image obtained using the fresh developing solutions and the visual density ($D_a$) of the image obtained using the color developing solutions stored for the stated period of time ($\Delta D = D_f - D_a$). Developing solutions having a poor storage stability have a small $D_a$ value, and, therefore, their ΔD values increase. That is, larger ΔD values indicate a greater deterioration of the developing solutions, and smaller ΔD values indicate less of a change in the photographic properties with the lapse of time and better storage stabilities.

The term visual density means the density determined using light to which the human eye is visually sensitive.

TABLE 1

| Photographic Property | None | 1-Phenyl-3-pyrazolidone Derivative 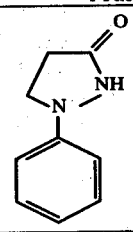 | 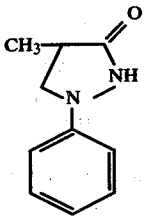 | 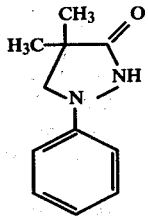 |
|---|---|---|---|---|
| $D_f$ | 1.30 | 2.34 | 2.33 | 2.36 |
| ΔD (stored for 2 weeks) | 0.02 | 0.36 | 0.16 | 0.04 |
| ΔD (stored for 3 weeks) | 0.06 | 1.07 | 0.56 | 0.06 |
| Degree of | o | x | Δ | o |

TABLE 1-continued

| Photographic Property | 1-Phenyl-3-pyrazolidone Derivative | | |
|---|---|---|---|
| | 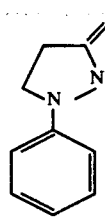 | 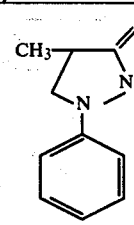 | 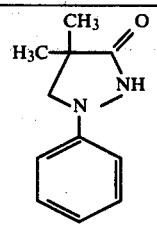 |
| | None | | |
| Coloration or Precipitation | | | |

Note: The grades used for the Degree of Coloration or Precipitation in Table 1 and the other tables given hereinafter were as follows:
o = No coloration nor precipitation.
Δ = Coloration and precipitation.
x = Intense coloration and a large amount of precipitation.

It is apparent from the results shown in Table 1 above than an improved stability to the lapse of time is obtained where a 4,4-dimethyl-substituted derivative as employed in the present invention is used.

EXAMPLE 2

The effects of the introduction of hydrophilic groups into the substituent group at the 4-position of the pyrazolidone derivative were examined in a similar manner as in Example 1. The results obtained are shown in Table 2 below.

TABLE 2

| Photographic Property | 1-Phenyl-3-pyrazolidone Derivative | | |
|---|---|---|---|
| | 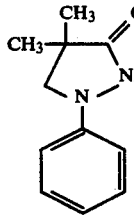 | 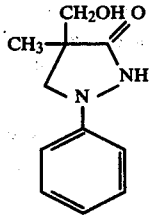 | 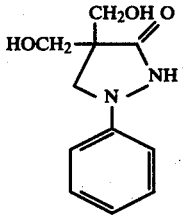 |
| $D_f$ | 2.34 | 2.44 | 2.54 |
| Fog (fresh solution) | 0.30 | 0.25 | 0.20 |
| ΔD (stored for 2 weeks) | 0.06 | 0.04 | 0.01 |
| ΔD (stored for 3 weeks) | 0.10 | 0.08 | 0.04 |
| Degree of Coloration or Precipitation | o | o | o |

It can be seen from the results in Table 2 above that the stability to the lapse of time is changed very little by the introduction of the hydrophilic group(s), and the fresh developing solutions containing the pyrazolidone derivatives with the hydrophilic group(s) are capable of providing higher densities and lower fog.

EXAMPLE 3

This example demonstrates that the lack of stability of 1-phenyl-3-pyrazolidones in color developing solutions is due to aerial oxidation.

Color developing solutions having the composition as described in Example 1 were prepared in which 1-phenyl-3-pyrazolidone or 4,4-dimethyl-1-phenyl-3-pyrazolidone was used as the additive in an amount of 0.8 g/liter.

1 liter portions of the color developing solutions were allowed to stand for one week at 25° C. and 60% RH, during which time the solutions were contacted with air in an area amount varying from 0 (tightly closed) to 500 $cm^2$/liter.

The amounts of unchanged pyrazolidone were determined to compare the ease of or resistance to aerial oxidation thereof.

For the purpose of comparison, similar procedures were carried out using a black-and-white developing solution containing 1-phenyl-3-pyrazolidone, having the following composition:

| | | |
|---|---|---|
| Sodium Sulfite (anhydrous) | 100 | g |
| Hydroquinone | 10 | g |
| Borax | 3 | g |
| Boric Acid | 3.5 | g |
| Potassium Bromide | 1 | g |
| 1-Phenyl-3-pyrazolidone | 0.5 | g |
| Water to make | 1 | l |

The results obtained are shown in Table 3 below.

TABLE 3

| | Specific Surface Area ($cm^2$) | | | | | |
|---|---|---|---|---|---|---|
| | 0 | 6 | 40 | 110 | 170 | 500 |
| Amount of Unchanged 1-Phenyl-3-pyrazolidone in Black-and-White Developer (g/l) | 0.50 | 0.50 | 0.47 | 0.45 | 0.45 | 0.45 |
| Amount of Unchanged 1-Phenyl-3-pyrazolidone in Color Developer (g/l) | 0.50 | 0.30 | 0.18 | 0.003 | 0 | 0 |
| Amount of Unchanged 4,4-Dimethyl-1-phenyl-3-pyrazolidone in Color Developer (g/l) | 0.50 | 0.45 | 0.40 | 0.40 | 0.38 | 0.30 |

It can be seen from the above results that a color developing solution containing 1-phenyl-3-pyrazolidone tends to deteriorate when it comes into contact with air.

These results also show that 1-phenyl-3-pyrazolidone, when incorporated into a color developing solution, tends to be deteriorated by aerial oxidation and is quite unstable, while the 1-phenyl-3-pyrazolidone is stable in a black-and-white developing solution.

This lack of stability, however, is not exhibited when a 4,4-disubstituted derivative of 1-phenyl-3-pyrazolidone according to the present invention is used.

When the developing solutions were stored without contact with air, both 1-phenyl-3-pyrazolidone and the 4,4-disubstituted derivative thereof remained quite stable and no difference in stability to alkali hydrolysis as described by J.F.A. Mason, *Processing Chemistry*, p. 85 (Focal Press) was exhibited.

These results also confirm that the lack of stability, in question, of 1-phenyl-3-pyrazolidone in color developing solutions is due to aerial oxidation, and the deterioration of the 1-phenyl-3-pyrazolidone due to aerial oxidation is much faster than that caused by alkali hydrolysis.

EXAMPLE 4

In this example, various hydroxylamine derivatives are investigated in combination with Compound (II) as a 1-phenyl-3-pyrazolidone derivative.

Color developing solutions were prepared having the following composition:

| | |
|---|---|
| Disodium Ethylenediaminetetraacetate | 2 g |
| Sodium Sulfite | 10 g |
| Compound (II)* | 1 g |
| N,N-Diethyl-p-phenylenediamine Sulfate | 6g |
| Potassium Carbonate | 30 g |
| Potassium Bromide | 2 g |
| 5-Nitrobenzoimidazole | 30 mg |
| Turkey Red Oil | 5 mg |
| Hydroxylamine Derivative (as shown in Table 4) | 5 mg |
| Water to make | 1 l |

The pH was adjusted to 10.2 (using sodium hydroxide or

-continued sulfuric acid).

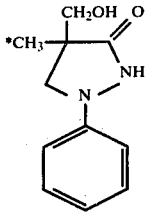

The color developing solutions were tested using the same procedure as described in Example 1, immediately after the preparation of the developer solutions or after two weeks storage of the developer solutions.

TABLE 4

| Hydroxylamine Derivative Used | ΔD | Degree of Coloration or Precipitation in Developer Solution |
|---|---|---|
| — | 0.40 | x |
| $NH_2OH$ | 0.16 | x |
| $NH_2OCH_3$ | 0.30 | x |
| $H_3CNHOH$ | 0.33 | Δ |
| 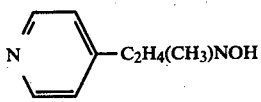 | 0.30 | Δ |
| $C_2H_5SO_2C_2H_4(CH_3)NOH$ | 0.08 | o |
| $(C_2H_5)_2NOH$ | 0.04 | o |
| $HOC_2H_4(C_2H_5)NOH$ | 0.07 | o |
| 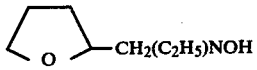 | 0.06 | o |
| $(i\text{-}C_3H_7)_2NOH$ | 0.32 | x |

It can be seen from the results shown in Table 4 above that hydroxylamine derivatives are effective for the stabilization of color developing solutions.

It can also be seen the N,N-dialkylhydroxylamines, particularly N,N-diethylhydroxylamine, are particularly preferred for stabilization.

While the invention has been described in detail and with reference to specific embodiments thereof, it will be apparent to one skilled in the art that various changes and modifications can be made therein without departing from the spirit and scope thereof.

What is claimed is:

1. A method for processing color images in an image-wise exposed silver halide color light-sensitive material using a developer solution of improved storage properties in contact with oxygen which comprises color developing an image-wise exposed silver halide color light-sensitive material in a developer solution containing (a) an aromatic primary amine color developing agent, (b) N,N-diethylhydroxylamine, and (c) a 1-aryl-3-pyrazolidone derivative containing two substituents groups at the 4-position thereof and having the general formula (I):

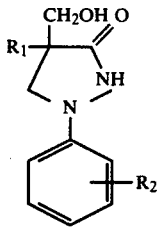

(I)

wherein $R_1$ is a hydroxymethyl group or a methyl group; $R_2$ is a hydrogen atom or a group having a Hammett substituent constant within the range of −0.40 to +0.25.

2. The method as described in claim 1, wherein said silver halide color light-sensitive material is a color radiographic light-sensitive material.

3. The method as described in claim 1, wherein said aryl group in the 1-position of said 1-aryl-3-pyrazolidone (c) is a para-substituted phenyl group.

4. The method as described in claim 1, wherein the amount of said N,N-diethylhydroxyamine is from about 0.05g to about 10g per liter of the developer solution.

5. The method as described in claim 1, wherein the amount of said N,N-diethylhydroxyamine is from about 0.1g to 5g.

6. The method as described in claim 1, wherein said 1-aryl-3-pyrazolidone derivative is used in an amount of from about 0.1 to about 10g/l of said developer solution.

7. The method as described in claim 1, wherein said 1-aryl-3-pyrazolidone derivative is used in an amount of from about 0.2 to 5g/l.

8. The method as described in claim 1, wherein said method comprises the sequence of color development, bleaching, washing, fixing, washing, stabilizing and drying.

9. The method as described in claim 1, wherein said method comprises the sequence of color development, bleach-fixing, washing, stabilizing and drying.

10. The method as described in claim 1, wherein said method comprises the sequence of color development, stop-fixing, bleach-fixing, washing, stabilizing and drying.

11. The method as described in claim 1, wherein said 1-phenyl-3-pyrazolidone derivative has the formula

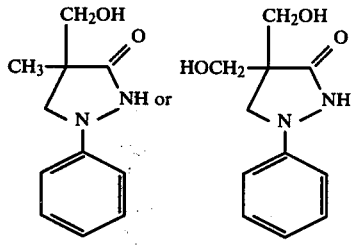

12. The method as described in claim 1, wherein said $R_2$ is a hydrogen atom, p-OH, p-$CH_3O$-, m-$(CH_3)_2N$-, p-$(CH_3)_3C$-, p-$CH_3S$-, p-$C_6H_5O$-, p-$NHCOCH_3$-, m-OH, p-$C_6H_5$-, p-F-, m-COOH, m-$CH_3O$-, p-COOH, m-$CH_3S$-, m-$C_6H_5$-, p-Cl-, p-$CH_3$-, m-$NH_2$-, p-$C_2H_5$-, p-$(CH_3)_2CH$-, m-$(CH_3)_3Si$-, m-$CH_3$- or p-Br-.

* * * * *